US009395165B2

(12) United States Patent
Maljkovic et al.

(10) Patent No.: US 9,395,165 B2
(45) Date of Patent: Jul. 19, 2016

(54) SUBSONIC AMMUNITION CASING

(71) Applicant: MAC, LLC, Bay Saint Louis, MS (US)

(72) Inventors: Nikica Maljkovic, New Orleans, LA (US); Joe Paul Gibbons, Jr., Diamondhead, MS (US); John Francis Bosarge, Jr., Pearlington, MS (US)

(73) Assignee: MAC, LLC, Bay St. Louis, MS (US)

( * ) Notice: Subject to any disclaimer, the term of this patent is extended or adjusted under 35 U.S.C. 154(b) by 0 days.

(21) Appl. No.: 14/876,480

(22) Filed: Oct. 6, 2015

(65) Prior Publication Data

US 2016/0025464 A1 Jan. 28, 2016

Related U.S. Application Data

(62) Division of application No. 13/561,947, filed on Jul. 30, 2012, now Pat. No. 9,182,204.

(60) Provisional application No. 61/512,553, filed on Jul. 28, 2011.

(51) Int. Cl.
*F42B 5/30* (2006.01)
*F42B 5/307* (2006.01)
(Continued)

(52) U.S. Cl.
CPC ... *F42B 5/26* (2013.01); *F42B 5/30* (2013.01); *F42B 5/307* (2013.01); *F42B 5/34* (2013.01); *F42B 33/10* (2013.01)

(58) Field of Classification Search
CPC ..... F42B 5/02; F42B 5/025; F42B 5/26; F42B 5/30; F42B 5/307; F42B 5/313; F42B 5/34; F42B 33/00; F42B 33/001; F42B 33/10
USPC ..... 102/464, 465, 466, 467, 469, 470, 447
See application file for complete search history.

(56) References Cited

U.S. PATENT DOCUMENTS 2,455,080 A 11/1948 Miller
3,060,856 A 10/1962 Dunn
(Continued)

FOREIGN PATENT DOCUMENTS

DE 2705235 A1 8/1978
DE 4015542 A1 11/1991
(Continued)

OTHER PUBLICATIONS

Extended European Search Report for European Application EP12817294.7, Report completed Aug. 12, 2014, Mailed Aug. 19, 2014, 7 Pgs.
(Continued)

*Primary Examiner* — James S Bergin
(74) *Attorney, Agent, or Firm* — KPPB LLP

(57) ABSTRACT

A subsonic ammunition cartridge casing having an engineered internal volume designed to allow for the introduction of precisely the amount of propellant necessary at precisely the desired location to reproducibly produce the desired projectile velocity and internal pressure is provided. The subsonic shell casing has an engineered internal propellant cavity built into the internal body of the casing itself that does not necessarily depend on the introduction of a separate volume reducing device such as tubing, filler, foam filler and the like. This ensures the integrity of the case, does not result in anything being expelled through the muzzle of the weapon other than the projectile, does not have any burning or combusting components, allows for very precise control of the internal volume and thus chamber pressure, and is economical to produce.

20 Claims, 5 Drawing Sheets

(51) Int. Cl.

| | |
|---|---|
| ***F42B 5/34*** | (2006.01) |
| ***F42B 33/10*** | (2006.01) |
| ***F42B 5/26*** | (2006.01) |

(56) References Cited

U.S. PATENT DOCUMENTS 3,144,827 A 8/1964 Boutwell
3,175,901 A 3/1965 Jesmont et al.
3,485,170 A 12/1969 Scanlon
3,609,904 A 10/1971 Scanlon
3,675,576 A 7/1972 Whitney
3,745,924 A * 7/1973 Scanlon ..... F42B 5/36 102/467
3,749,023 A 7/1973 Kawaguchi et al.
3,989,017 A 11/1976 Reece
3,989,792 A 11/1976 San Miguel
3,990,366 A 11/1976 Scanlon
4,065,437 A 12/1977 Blinne et al.
4,108,837 A 8/1978 Johnson et al.
4,147,107 A 4/1979 Ringdal
4,157,684 A * 6/1979 Clausser ..... F42B 5/02 102/430
4,175,175 A 11/1979 Johnson et al.
4,228,218 A 10/1980 Takayanagi et al.
4,308,847 A 1/1982 Ruizzo
4,326,462 A 4/1982 Garcia et al.
4,565,131 A 1/1986 Buchner
4,569,288 A 2/1986 Grelle et al.
4,574,703 A 3/1986 Halverson
4,614,157 A 9/1986 Grelle et al.
4,711,271 A 12/1987 Weisenbarger et al.
4,726,296 A 2/1988 Leshner et al.
4,809,612 A 3/1989 Ballreich et al.
4,839,435 A 6/1989 Gergen et al.
4,867,065 A 9/1989 Kaltmann et al.
4,897,448 A 1/1990 Romance
4,958,567 A 9/1990 Olson
4,969,386 A 11/1990 Sandstrom et al.
5,033,386 A * 7/1991 Vatsvog ..... F42B 5/307 102/430
5,062,343 A 11/1991 Sjoberg et al.
5,129,382 A 7/1992 Stamps et al.
5,151,555 A * 9/1992 Vatsvog ..... F42B 5/307 86/10
5,161,512 A 11/1992 Adam et al.
5,175,040 A 12/1992 Harpell et al.
5,190,018 A 3/1993 Costello et al.
5,196,252 A 3/1993 Harpell
5,227,457 A 7/1993 Marrocco, III et al.
5,259,288 A * 11/1993 Vatsvog ..... F42B 5/307 102/430
5,404,913 A 4/1995 Gilligan
5,434,224 A 7/1995 McGrail et al.
5,471,905 A 12/1995 Martin
5,496,893 A 3/1996 Gagne et al.
5,512,630 A 4/1996 Gagne et al.
5,519,094 A 5/1996 Tseng et al.
5,539,048 A 7/1996 Gagne et al.
5,558,765 A 9/1996 Twardzik
5,565,543 A 10/1996 Marrocco et al.
5,585,450 A 12/1996 Oaks et al.
5,616,650 A 4/1997 Becker et al.
5,625,010 A 4/1997 Gagne et al.
5,637,226 A 6/1997 Adam et al.
5,646,231 A 7/1997 Marrocco, III et al.
5,646,232 A 7/1997 Marrocco, III et al.
5,654,392 A 8/1997 Marrocco, III et al.
5,659,005 A 8/1997 Marrocco, III et al.
5,668,245 A 9/1997 Marrocco et al.
5,670,564 A 9/1997 Gagne et al.
5,691,401 A 11/1997 Morita et al.
5,721,335 A 2/1998 Marrocco, III et al.
5,731,400 A 3/1998 Marrocco, III et al.
5,755,095 A 5/1998 Maurer
5,756,581 A 5/1998 Marrocco, III et al.
5,760,131 A 6/1998 Marrocco, III et al.
5,770,815 A * 6/1998 Watson, Jr. ..... F42B 5/16 102/439
5,789,521 A 8/1998 Marrocco, III et al.
5,822,904 A * 10/1998 Beal ..... F42B 12/74 102/430
5,824,744 A 10/1998 Gagne et al.
5,827,527 A 10/1998 Leonard
5,827,927 A 10/1998 Gagne et al.
5,830,945 A 11/1998 Gagne et al.
5,869,592 A 2/1999 Gagne et al.
5,886,130 A 3/1999 Trimmer et al.
5,976,437 A 11/1999 Marrocco, III et al.
6,087,467 A 7/2000 Marrocco, III et al.
6,135,097 A 10/2000 Ruizzo, Jr. et al.
6,228,970 B1 5/2001 Savariar
6,283,035 B1 * 9/2001 Olson ..... F42B 5/02 102/439
6,367,441 B1 4/2002 Hoshiba et al.
6,387,985 B1 5/2002 Wilkinson et al.
6,441,099 B1 8/2002 Connell et al.
6,525,125 B1 2/2003 Giardello et al.
6,528,145 B1 3/2003 Berger et al.
6,586,554 B1 7/2003 Takahashi
6,630,538 B1 10/2003 Ellul et al.
6,752,084 B1 6/2004 Husseini et al.
6,845,716 B2 1/2005 Husseini et al.
7,610,858 B2 * 11/2009 Chung ..... F42B 5/313 102/466
7,992,498 B2 8/2011 Ruhlman et al.
8,240,252 B2 8/2012 Maljkovic et al.
8,408,137 B2 4/2013 Battaglia
8,443,730 B2 5/2013 Padgett
8,561,543 B2 * 10/2013 Burrow ..... F42B 5/307 102/466
8,763,535 B2 * 7/2014 Padgett ..... F42B 5/313 102/466
8,813,650 B2 8/2014 Maljkovic et al.
8,869,702 B2 10/2014 Padgett
9,032,855 B1 5/2015 Foren et al.
9,182,204 B2 * 11/2015 Maljkovic ..... F42B 33/10
9,188,412 B2 * 11/2015 Maljkovic ..... F42B 5/307
2001/0013299 A1 8/2001 Husseini et al.
2002/0035946 A1 3/2002 Jamison et al.
2003/0019385 A1 1/2003 LeaSure et al.
2003/0131751 A1 7/2003 MacKerell et al.
2003/0181603 A1 9/2003 Venderbosch et al.
2004/0096539 A1 5/2004 McCaffrey et al.
2004/0211668 A1 10/2004 Montminy et al.
2005/0005807 A1 1/2005 Wiley et al.
2005/0016414 A1 1/2005 Leitner-Wise
2005/0049355 A1 3/2005 Tang et al.
2005/0066805 A1 3/2005 Park et al.
2005/0188879 A1 9/2005 Wiley et al.
2006/0013977 A1 1/2006 Duke et al.
2006/0056958 A1 3/2006 Gaines et al.
2006/0069236 A1 3/2006 Brunelle et al.
2006/0102041 A1 5/2006 Wiley et al.
2006/0105183 A1 5/2006 Chu et al.
2006/0207464 A1 9/2006 Maljkovic et al.
2007/0172677 A1 7/2007 Biermann et al.
2007/0261587 A1 11/2007 Chung
2008/0017026 A1 1/2008 Dondlinger et al.
2009/0211483 A1 8/2009 Kramer
2010/0016518 A1 1/2010 El-Hibri et al.
2010/0282112 A1 11/2010 Battaglia
2011/0214583 A1 9/2011 Dutch
2012/0024183 A1 2/2012 Klein
2012/0052222 A1 3/2012 Gagne
2012/0111219 A1 5/2012 Burrow et al.
2012/0180687 A1 * 7/2012 Padgett ..... F42B 5/313 102/466
2012/0180688 A1 7/2012 Padgett
2013/0014664 A1 1/2013 Padgett et al.
2013/0014665 A1 1/2013 Maljkovic et al.
2013/0186294 A1 7/2013 Davies et al.
2014/0060372 A1 3/2014 Padgett et al.
2014/0060373 A1 3/2014 Maljkovic et al.
2014/0076188 A1 3/2014 Maljkovic et al.

(56) References Cited

U.S. PATENT DOCUMENTS

| | | | | |
|---|---|---|---|---|
| 2014/0290522 | A1 | 10/2014 | Padgett et al. | |
| 2015/0033970 | A1 | 2/2015 | Maljkovic et al. | |
| 2015/0047527 | A1 | 2/2015 | Padgett | |
| 2015/0285604 | A1 | 10/2015 | Bosarge et al. | |
| 2015/0316361 | A1* | 11/2015 | Maljkovic ..... | F42B 5/30 102/466 |
| 2016/0040970 | A1 | 2/2016 | Maljkovic et al. | |

FOREIGN PATENT DOCUMENTS

| | | | |
|---|---|---|---|
| EP | 222827 | B1 | 5/1991 |
| EP | 436111 | A2 | 7/1991 |
| FR | 861071 | A | 1/1941 |
| GB | 672706 | A | 5/1952 |
| GB | 732633 | A | 6/1955 |
| GB | 1568545 | A | 5/1980 |
| WO | 8300213 | A1 | 1/1983 |
| WO | 8606466 | A1 | 11/1986 |
| WO | 8907496 | A1 | 8/1989 |
| WO | 9207024 | A1 | 4/1992 |
| WO | 9513516 | A1 | 5/1995 |
| WO | 9839250 | A1 | 9/1998 |
| WO | 2008090505 | A2 | 7/2008 |
| WO | 2013016730 | A1 | 1/2013 |
| WO | 2015130409 | A2 | 9/2015 |
| WO | 2015154079 | A1 | 10/2015 |

OTHER PUBLICATIONS

International Search Report and Written Opinion for International Application No. PCT/US2008/072810, completed Oct. 19, 2008, 9 pgs.

International Search Report and Written Opinion for International Application PCT/US2012/048848, completed Oct. 12, 2012, 8 pgs.

International Search Report and Written Opinion for International Application PCT/US2015/0011238, Report Completed Sep. 1, 2015, Mailed Sep. 30, 2015, 10 pgs.

International Search Report and Written Opinion for International Application PCT/US2015/024528, Report Completed Jun. 16, 2015, Mailed Jul. 8, 2015, 7 pgs.

IPRP for International Application No. PCT/US2012/048848, Search Completed Jan. 28, 2014, 7 pgs.

"A Guide to Polycarbonate in General", Engineering Polymer Specialists Polymer Technology & Services, LLC, pp. 1-5.

"Development Product Makrolon® DPI-1848, Polycarbonate Copolymer Resin General Purpose Grade", Bayer Polymers, May 2003, pp. 1-4.

"GE Plastics, Lexan® EXL9330 Americas: Commercial", General Electric Company, Sep 29, 2004, pp. 1-5.

"Low Temperature Notched Izod Impact of RADEL R-5xxx Resins", File No. 2803, Solvay Advanced Polymers, L.L.C., Jan. 7, 1999, 1 pg.

"Preliminary Product Data, RTP 1899A X 83675 Polycarbonate/Acrylic Alloy (PC/PMMA) Thin Wall Grade", RTP Company Product Data Sheet, available at http://www.rtpcompany.com/info/data/1800A/RTP1899AX83675.htm, printed, Mar. 7, 2005, 5 pgs.

"Standard Test Methods for Determining the Izod Pendulum Impact Resistance of Plastics,1", ASTM Designation: D256-00, Jan. 2001, pp. 1-19.

Baldwin et al., "A microcellular processing study of poly(ethylene terephthalate) in the amorphous and semicrystalline states. Pat I: microcell nucleation", Society of Plastics Engineers, Polymer Engingeering and Science (1996), vol. 36 (11), pp. 1437-1445.

Naitove, "Self-reinforcing thermoplastic is harder, stronger, stiffer without added fibers", Plastics Technology, Gardner Publication Inc., Jul. 2003, 2 pgs.

* cited by examiner (PRIOR ART)

SUBSONIC AMMUNITION CASING

CROSS-REFERENCE TO RELATED APPLICATION

The present application is a division application of U.S. patent application Ser. No. 13/561,947, filed Jul. 30, 2012, which application claimed priority to U.S. Provisional Application No. 61/512,553, filed Jul. 28, 2011, which are incorporated herein by reference in their entirety.

FIELD OF THE INVENTION

The present invention generally relates to ammunition articles, and more particularly to subsonic ammunition casings formed from polymeric materials.

BACKGROUND

In the field, two types of ammunition are generally recognized: traditional supersonic ammunition, which fires projectiles with velocities exceeding the speed of sound; and subsonic ammunition, which fires projectiles with velocities less than that of the speed of sound. This low-speed characteristic of the subsonic ammunition makes it much quieter than typical supersonic ammunition. The speed of sound is variable depending on the altitude and atmospheric conditions, but is generally in the range of 1,000-1,100 feet per second (fps), most commonly given at 1,086 fps at standard atmospheric conditions.

Ideally, these subsonic rounds need to work interchangeably with supersonic rounds in their ability to fit properly in the same firearm chamber. The traditional method of forming subsonic rounds is to simply reduce the propellant charge in the shell until the velocity is adequately reduced. Unfortunately, this solution is not ideal for a number of reasons. Principally these problems are rooted in the relatively large empty volume inside the case left vacant by the reduced propellant charge. This empty volume inhibits proper propellant burn, results in inconsistent propellant positioning, causes reduced accuracy, and, in special situations, may lead to extremely high propellant burn rates or even propellant detonation, an extremely dangerous situation for the weapon user. For example, since the propellant is free to move in the large empty volume, shooting upward with the propellant charge near the primer gives different velocity results than when shooting downward with the propellant charge forward. Finally, usage of subsonic ammunition, and its attending lower combustion pressures, frequently results in the inability to efficiently cycle semi-automatic or fully automatic weapons, such as the M16, M4, AR10, M2, M107s and the like. For repeating weapons to properly cycle, the propellant charge must produce sufficient gas pressure and/or volume to accelerate the projectile and to cycle the firing mechanism. Typical supersonic chamber pressures will be in the range from 30,000 psi to 70,000 psi. With a reduced quantity of propellant, subsonic ammunition generally fails to produce sufficient pressure to properly cycle the firing mechanism.

Over the years, a number of attempts have been made to safely and economically address these issues. These attempts have included the introduction of inert fillers, expandable inner sleeves that occupy the empty space between the propellant and the projectile (U.S. Pat. No. 4,157,684), insertion of flexible tubing (U.S. Pat. No. 6,283,035), foamed inserts (U.S. Pat. No. 5,770,815), stepped down stages in the discharge end of cartridge casings (U.S. Pat. No. 5,822,904), or complicated three and more component cartridges with rupturable walls and other complicated features (U.S. Pat. No. 4,958,567), all of which are incorporated herein by reference. Another approach has been to use standard cartridges in combination with non-standard propellants, such as is exemplified by U.S. Pat. Pub. No 2003/0131751, the disclosure of which is also incorporated herein by reference.

The result of such prior attempts to solve the production of reliable subsonic cartridges have been subsonic rounds that have a larger spread in velocity and thus less accuracy potential than what is desired. Moreover, associated production costs can be significantly greater than full velocity rounds because of the large number of additional manufacturing steps required to insert and secure the inserts used, or to construct the complicated shell casings required. Accordingly, a need exists to develop solutions that make it possible to manufacture better and more price competitive subsonic ammunition than previously available.

SUMMARY OF THE INVENTION

The current invention is directed to a novel subsonic casing for an ammunition article capable of being formed at least partially of a polymeric material.

In some embodiments, the invention is directed to a subsonic ammunition article including

- a casing defining a generally cylindrical hollow body having a cap at a first end thereof and a caselet at a second end thereof, the caselet having a proximal end defining a body region and a distal end defining a neck region, wherein the cap is interconnected with the proximal end of the caselet such that the casing at least partially encloses an internal cavity, and wherein the outer diameter of the caselet narrows from a first diameter at the body region to a second diameter at the neck region;
- at least one propellant chamber disposed within the internal cavity of the casing, the propellant chamber having an open internal volume that is at least 20% reduced in comparison to the open internal volume of a standard casing of equivalent caliber;
- a propellant disposed and confined within the propellant chamber;
- a primer disposed at the first end of the casing in combustible communication with the propellant;
- wherein the caselet and the propellant chamber is at least partially formed of a substantially polymeric material; and
- wherein the ratio of the minimum thickness of the wall of the body region of the caselet to the average wall thickness of the neck region of the ammunition casing, as defined by the middle of its tolerance range, is greater than 3.

In one such embodiment, the polymeric material additionally includes at least one additive selected from plasticizers, lubricants, molding agents, fillers, thermo-oxidative stabilizers, flame-retardants, coloring agents, compatibilizers, impact modifiers, release agents, reinforcing fibers.

In another such embodiment, the article additionally includes one or more projectiles fitted in the second end. In such an embodiment, the projectile upon firing does not exceed the velocity of 1086 feet per second at standard atmospheric conditions. In another such embodiment the projectile is secured to the casing by a interconnection selected from the group consisting of mechanical interference, adhesive, ultrasonic welding, the combination of molding in place and adhesive, and hot crimping after the act of molding.

In still another such embodiment, the polymeric material comprises a material selected from the group consisting of polyphenylsulfone, polycarbonate, and polyamide. In such an embodiment, the polymeric material may include a translucent or transparent polymer. In another such embodiment, the polymeric material may include a polymeric material possessing a glass transition temperature of less than 250° C.

In yet another such embodiment, the cap and the caselet are joined using one of either a snap fit or threads. In one such embodiment, the ammunition article headspace is adjusted by rotating the threads clockwise and/or counterclockwise until a desired headspace distance is reached.

In still yet another such embodiment, the space defined between the outer wall of the caselet and the wall of the propellant chamber is formed of a solid material.

In still yet another such embodiment, the space defined between the outer wall of the caselet and the wall of the propellant chamber includes one of either voids or ribs.

In still yet another such embodiment, the propellant chamber comprises multiple separate internal volumes each in combustible communication with the primer.

In still yet another such embodiment, the propellant chamber has a radial cross-section selected from the group consisting of circular, ovoid, octagonal, hexagonal, triangular, and square. In one such embodiment, the radial cross-section of the propellant chamber is irregular along its longitudinal length. In another such embodiment, the radial size of the propellant chamber tapers along its longitudinal direction.

In other embodiments, the propellant chamber is formed of a separate restrictor body disposed within the internal cavity of the casing.

In one such embodiment, the caselet and restrictor body are formed of different polymeric materials.

In another such embodiment, the caselet and restrictor body are formed from the same polymeric material.

In still other embodiments, the propellant chamber and caselet are formed of a single integral caselet body.

In one such embodiment, the single integral caselet body is manufactured from two or more polymeric materials in a blend mixture.

In another such embodiment, the single integral caselet body is manufactured from two or more polymeric materials in distinct layers.

In still another such embodiment, the cap and the single integral caselet body are joined using one of either a snap fit or threads.

In yet other embodiments, the propellant chamber, caselet and cap are of a single integral casing body.

In one such embodiment, the single integral casing body is manufactured from two or more polymeric materials in a blend mixture.

In another such embodiment, the single integral casing body is manufactured from two or more polymeric materials in distinct layers.

In still another such embodiment, a metallic component is used to separate the primer from the other components of the case.

In still yet other embodiments, the invention is directed to a method of reusing a subsonic ammunition article including:

providing a casing defining a generally cylindrical hollow body having a cap at a first end thereof and a caselet at a second end thereof, the caselet having a proximal end defining a body region and a distal end defining a neck region, wherein the cap is interconnected with the proximal end of the caselet such that the casing at least partially encloses an internal cavity, and wherein the outer diameter of the caselet narrows from a first diameter at the body region to a second diameter at the neck region, the article having at least one propellant chamber disposed within the internal cavity of the casing, the propellant chamber having an open internal volume that is at least 20% reduced in comparison to the open internal volume of a standard casing of equivalent caliber, the casing further having a propellant disposed and confined within the propellant chamber and a primer disposed at the first end of the casing in combustible communication with the propellant, wherein the caselet and the propellant chamber at least partially comprise a substantially polymeric material, and wherein the ratio of the minimum thickness of the wall of the body region of the caselet to the average wall thickness of the neck region of the ammunition casing, as defined by the middle of its tolerance range, is greater than 3;

firing the ammunition article; and discarding the fired polymeric caselet, retaining the fired metallic cap and attaching a new polymeric caselet to the existing metallic cap.

In one such embodiment, the cap and casing are threadingly interconnected.

In another such embodiment, the headspace of the ammunition article is adjusted by rotating the threads clockwise and/or counterclockwise until a desired headspace distance is reached.

BRIEF DESCRIPTION OF THE DRAWINGS

The description will be more fully understood with reference to the following figures, which are presented as exemplary embodiments of the invention and should not be construed as a complete recitation of the scope of the invention, wherein.

DETAILED DESCRIPTION

Figure 1:
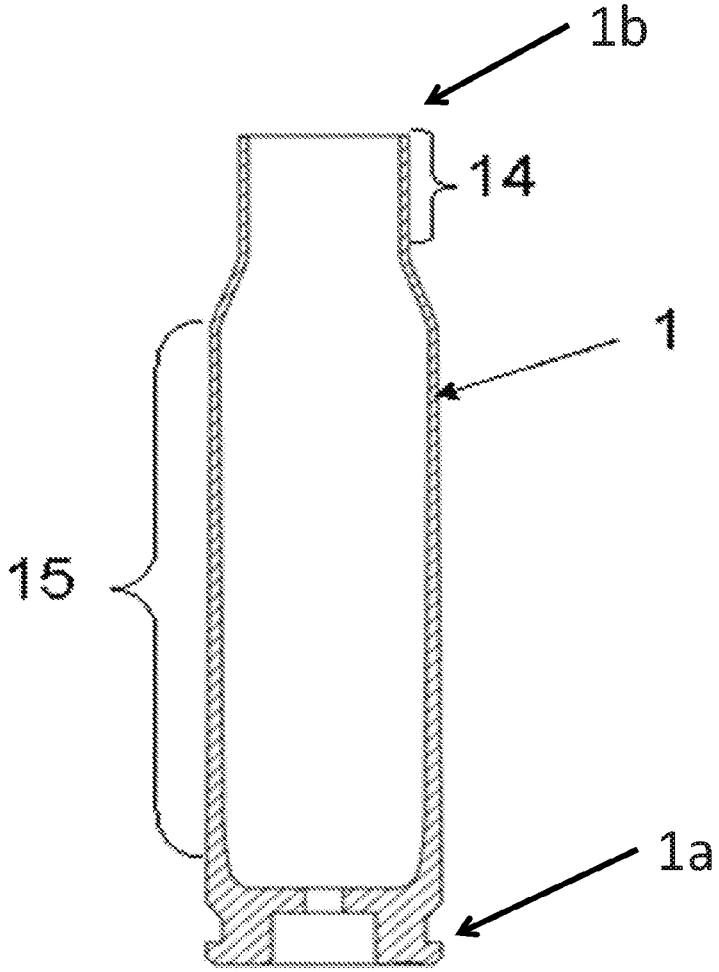
FIG. 1 depicts a cross-sectional schematic of a conventional metallic ammunition cartridge casing.

The current invention is directed to a subsonic ammunition cartridge casing having an engineered internal volume designed to allow for the introduction of precisely the amount of propellant necessary at precisely the desired location to reproducibly produce the desired projectile velocity and internal pressure. More specifically, the current invention provides a shell casing having an engineered internal propellant cavity built into the internal body of the casing itself that does not necessarily depend on the introduction of a separate volume reducing device such as tubing, filler, foam filler and the like. This ensures the integrity of the case, does not result in anything being expelled through the muzzle of the weapon other than the projectile, does not have any burning or combusting components, allows for very precise control of the internal volume and thus chamber pressure, and is economical to produce.

For the purposes of the present invention, the term "ammunition article" as used herein refers to a complete, assembled round or cartridge of ammunition that is ready to be loaded into a firearm and fired, including cap, casing, propellant, projectile, etc. An ammunition article may be a live round fitted with a projectile, or a blank round with no projectile. An ammunition article may be any caliber of pistol or rifle ammunition and may also be other types such as non-lethal rounds, rounds containing rubber bullets, rounds containing multiple projectiles (shot), and rounds containing projectiles other than bullets such as fluid-filled canisters and capsules. The "cartridge casing" is the portion of an ammunition article that remains intact after firing. A cartridge casing may be one-piece or multi-piece.

Also for the purposes of the present invention, the term "subsonic ammunition" as used herein refers to a specialized type of ammunition with projectile velocities of less than the speed of sound. The speed of sound is variable depending on the altitude and atmospheric conditions but is generally in the range of 1,000-1,100 feet per second (fps). For example, while traditional 7.62 mm ammunition generates projectile velocities of 2000-3000 fps, the subsonic ammunition would generally generate projectile velocities of less than 1070 fps.

A traditional cartridge casing, as shown in FIG. 10, generally comprises a one-component deep-drawn elongated body 1 with a primer end 1*a* and a projectile end 1*b*. During use, a weapon's cartridge chamber supports the majority of the cartridge casing wall in the radial direction, but, in many weapons, a portion of the cartridge base end is unsupported. During firing, a stress profile is developed along the cartridge casing where the greatest stresses are concentrated at the base end. Therefore, the cartridge base end must possess the greatest mechanical strength, while a gradual decrease in material strength is acceptable in metal cartridges axially along the casing toward the end that receives the projectile.

In discussing a casing it is useful to define two regions, the "neck" portion of the cartridge casing (designated as 14) near the open end of the casing where the projectile is fitted, and a "body" portion (designated as 15) near where the caselet meets the cap. A key guidance of this invention is a relationship between the wall thicknesses along these two regions 14 and 15. The wall thicknesses in region 15 are represented by the minimum wall thickness of the body portion of the cartridge case and is designated "B". The average thickness of the neck portion 14 is designated "N". The relationship between the two is a ratio of dividing the "B" by "N" and is designated Ratio B/N. Typical B/N values for traditional cartridge casings are given in Table I, below.

TABLE I

Typical Supersonic Cartridge Case Dimensions

| Caliber | N | B | Ratio B/N |
|---|---|---|---|
| 5.56 mm | 11.5 | 7.5 | 0.65 |
| 7.62 mm | 15 | 13 | 0.87 |
| 50 BMG | 21 | 20 | 0.95 |

(Units are 1/1000 of an inch; values are for minimum wall thickness for B and the middle of the tolerance range for N)

An examination of the values in Table I shows that neck thicknesses (N) are in general larger than the body wall thicknesses (B). It is readily apparent from the Table I that this relationship holds across the spectrum of calibers. All of the calibers show this Ratio to be at or below 0.95, with smaller calibers showing progressively smaller Ratio values.

Figure 2:
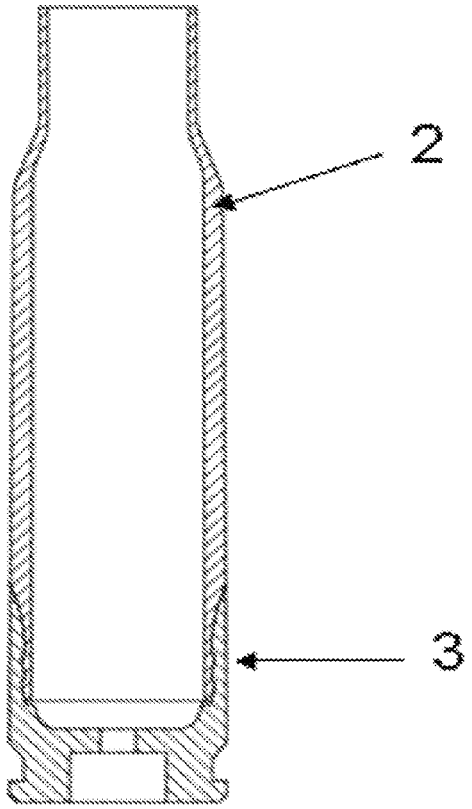
FIG. 2 depicts a cross-sectional schematic of a conventional hybrid polymeric/metallic ammunition cartridge casing.

Hybrid polymer-metal cartridge casings (FIG. 2) are also well known in the art. In such a casing, a polymeric caselet 2 constitutes the forward portion of a cartridge casing, and a metallic cap 3 forms the closed, rearward casing portion. The proportion of plastic to metal can vary, a larger percentage of plastic being preferred to maximize weight reduction, corrosion resistance, and other advantages of plastics. The amount of metal present is determined by the smallest metal cap size necessary to prevent cartridge failure during firing. The hybrid polymer-metal casing is meant to mimic the function of a standard supersonic metallic cartridge casing, and thus does not function well as the casing for the subsonic ammunition article. In particular, although there are additional material considerations in constructing a hybrid casing, as shown the B/N ratio is typically identical to conventional all metal casings.

It has now been determined that a reliable, economic subsonic cartridge casing may be produced by the careful design and construction of an engineered internal propellant chamber within the overall internal volume of the casing. In particular, it has been found that producing an engineered internal propellant chamber having an internal volume that is at least 20% reduced in comparison with the equivalent supersonic metallic, hybrid or polymeric casing of the same caliber, while simultaneously ensuring that the cartridge casing overall has a B/N ratio greater than 3 creates an optimal internal geometry for propellant discharge in subsonic ammunition applications. In addition, using such an integrated and engineered internal propellant chamber allows the ammunition manufacturer to assemble the cartridge casing in a rapid fashion without the need for additional manufacturing steps or complex design parameters.

Figure 3:
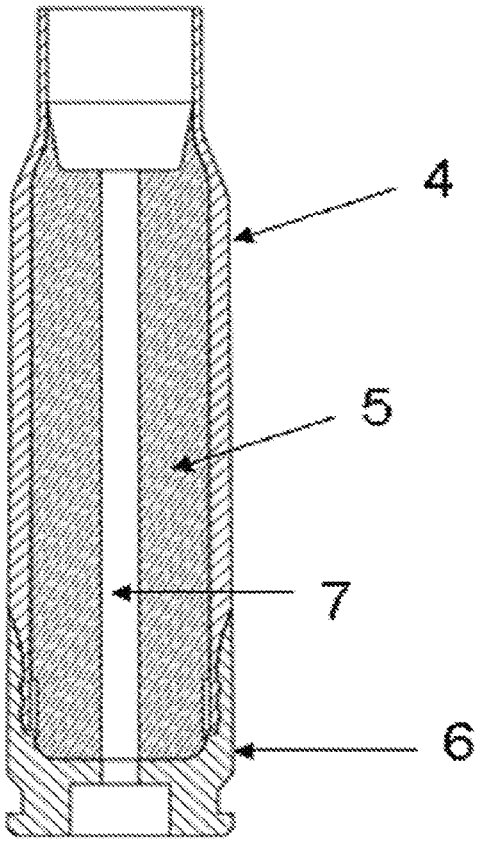
FIG. 3 depicts a cross-sectional schematic of a two-piece sub-sonic ammunition cartridge casing in accordance with embodiments of the current invention.

In accordance with this understanding, and referencing for illustrative purposed only FIG. 3, embodiments of the cartridge casing invention of the current application generally include comprise at least a polymeric caselet 4, an engineered propellant or powder chamber 7, within the overall internal casing volume 5, and a cap 6. More specifically, the cartridge casing defines a generally cylindrical hollow body having a cap 6 at a first end thereof and a caselet 4 at a second end thereof, the caselet having a proximal end defining a body region 14 and a distal end defining a neck region 15, wherein in multi-component casings, such as that shown in FIG. 3, the cap is interconnected with the proximal end of said caselet such that the casing at least partially encloses an engineered propellant volume or chamber 7, and wherein the diameter of the caselet narrows from a first diameter "B" at the body region to a second diameter "N" at the neck region. The cap houses a live primer and is joined securely to the caselet, as will be described below. A propellant charge is introduced into the engineered volume 7 formed by the assembled casing and placed into combustible communication with the primer. A projectile (not shown) may be inserted into the open caselet end and secured as described below, or the open caselet end may be closed to form a blank. In this invention, as described above, the critical structure is the reduced volume of the engineered internal propellant volume 7 and the B/N ratio of the caselet.

Although the above discussion focused on the overall elements of the subsonic casing of the instant invention, and the critical engineered propellant volume, it should be understood that the actual construction of the engineered propellant volume, and its integration into the overall casing may take a number of suitable forms. First, FIG. 3 itself shows one possible embodiment of the invention. In this embodiment, the subsonic casing is constructed from a hybrid two-piece casing design. A hybrid two-piece casing design, such as that shown in FIGS. 2 and 3, lends itself well to the incorporation of a separate polymeric restrictor 5 into the caselet 4 to partially form the engineered propellant volume or chamber 7. In such an embodiment, the restrictor is easily inserted from the primer end of caselet 4, prior to the attachment of cap 6. Following the attachment of the cap 6 to the caselet 4 the restrictor 5 is held tightly within the resulting shell and therefore the whole casing structure of FIG. 3 remains intact following the firing event without risk of expulsion from the casing or attendant movement of the restrictor or propellant in relation to other elements of the casing.

Figure 4:
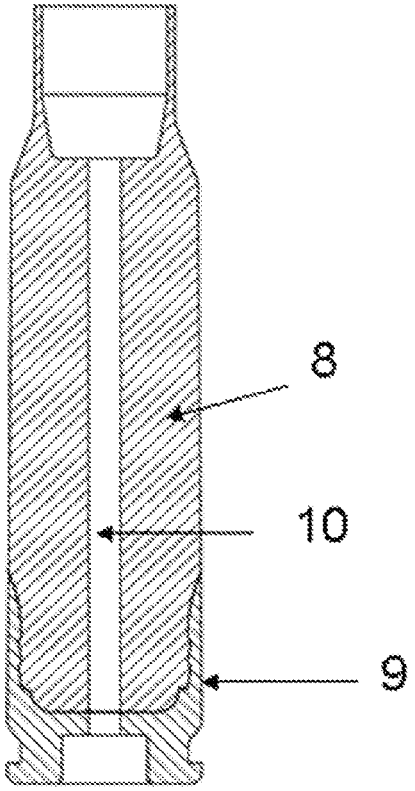
FIG. 4 depicts a cross-section schematic of a two-piece sub-sonic ammunition cartridge casing in accordance with other embodiments of the current invention.

More preferred embodiments of the invention incorporate a cartridge casing wherein the internal propellant volume is an integral portion of the caselet. FIG. 4 illustrates this embodiment. As shown, in these embodiments the caselet wall itself forms the engineered propellant volume or chamber in 10 a single integral injection molded polymeric caselet component, or "reduced volume caselet" 8. As in other hybrid casings in accordance with the present invention, the overall cartridge casing also contains metallic cap 9 that partially encloses the engineered volume 10. Again, this propellant chamber is engineered such that it is at least 20% reduced in comparison to the equivalent supersonic cartridge casing, and the overall casing body has a B/N ratio greater than 3. (It should be understood that the amount of internal volume reduction is determined by exact need for the propellant charge in order to meet the subsonic projectile requirement. Non-limiting amounts of internal volume reduction in a cartridge casing are about 20%, more preferably about 30%, even more preferably about 40%, still more preferably about 50%, yet more preferably about 60%, even more preferably about 70%, more preferably about 80% and up.)

Regardless of how the engineered propellant volume is formed, in such hybrid casings, a polymeric caselet constitutes the forward portion of a cartridge casing, and a metallic cap forms the closed, rearward casing portion. The proportion of plastic to metal can vary, a larger percentage of plastic being preferred to maximize weight reduction, corrosion resistance, and other advantages of plastics. The amount of metal present is determined by the smallest metal cap size necessary to prevent cartridge failure during firing. Non-limiting amounts of polymeric material in a cartridge casing by weight are about 10%, more preferably about 20%, even more preferably about 30%, still more preferably about 40%, yet more preferably about 50%, even more preferably about 60%, more preferably about 70% and up.

For such hybrid casings, many prior art methods are known for attaching the cap and caselet portions of an ammunition cartridge casing. Any method of attaching the caselet and cap is acceptable provided that the two components are joined securely and that gaseous combustion products are not allowed to escape through the assembled casing upon firing. Possible securing methods include, but are not limited to, mechanical interlocking methods such as ribs and threads, adhesives, molding in place, heat crimping, ultrasonic welding, friction welding etc. These and other suitable methods for securing individual pieces of a two-piece or multi-piece cartridge casing are useful in the practice of the present invention.

Figure 5:
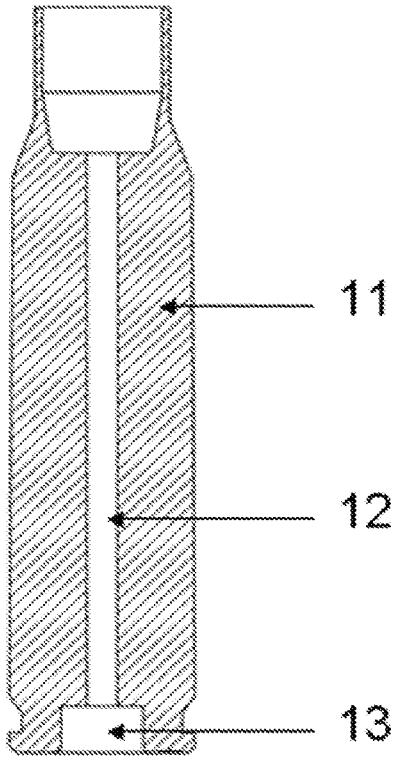
FIG. 5 depicts a cross-section schematic of a one-piece sub-sonic ammunition cartridge casing in accordance with other embodiments of the current invention.

An even more preferred embodiments of the invention comprises a subsonic cartridge casing that eliminates the need for the metallic cap and is injection molded in its entirety. FIG. 5 illustrates this embodiment. This embodiment combines the caselet and cap into a single integral injection molded polymeric casing component forming the engineered propellant chamber, or "reduced volume casing" 11. As in the other embodiments of the invention the propellant chamber 12 must still be engineered to be reduced to a minimum of 20% compared to its supersonic equivalent, while the cartridge casing has a B/N ratio greater than 3. Optionally, this embodiment may include a metallic component (not shown) directly abutting the primer capsule 13, isolating the primer from the polymeric portion. This primer isolation component is limited in nature and does not come in contact with any of the propellant, in contrast to the metallic caps of other embodiments of this invention.

It is notable that given the extreme nature of the application, a useful design must perform perfectly a great majority of time. Preferably, polymeric cartridge casings will survive more than 99% of live ammunition firings; more preferably, more than 99.9%; even more preferably, more than 99.99%; still more preferably, more than 99.999%. Even higher success rates are more preferable, the most preferable scenario being 100% casing survival. It is also important to note that this design alone is not the only factor guiding the suitability of a given material for polymeric case material, but has to be viewed in the context of additional factors such as material selection, creep resistance, melting and glass transition temperature points, chemical resistance, dimensional stability, particular application requirements, coefficient of friction between the chamber and the case, usage at extreme high temperatures such as 125° F., 140° F. or even 160 and 165° F., extreme low temperatures such as −25° F., −40° F. or even −65° F. and the like.

Suitable polymeric materials, for both the cap or caselet may be selected from any number of polymeric materials. Non limiting examples include polyamides, polyimides, polyesters, polycarbonates, polysulfones, polylactones, polyacetals, acrylontrile/butadiene/styrene copolymer resins, polyphenylene oxides, ethylene/carbon monoxide copolymers, polyphenylene sulfides, polystyrene, styrene/acrylonitrile copolymer resins, styrene/maleic anhydride copolymer resins, aromatic polyketones and mixtures thereof. Preferred embodiments will be manufactured from any polymer with a glass transition temperature of less than 250° C. Particularly suitable materials include polyphenylsulfones, polycarbonates and polyamides.

It will also be recognized that in any of the embodiments described above, the outer wall and inner volume occupying portions of the caselet need not necessarily be of the same polymeric material. For example, the caselet outer wall could be made of polymers with higher temperature resistance to resist the hot chamber conditions, while the inner volume occupying portion of the caselet (or in those embodiments with a separate element the restrictor) could be manufactured out of low cost polymers or be made with voids or ribs to reduce the amount of material used. One skilled in the art will also readily observe that different or identical coloring of the polymers used could aid in identification or marketing of the ammunition of the current invention. Another embodiment of this invention would be the usage of transparent or translucent polymers, allowing for easy identification of the propellant level.

In a preferred embodiment of the present invention, the polymeric caselet is injection molded from a suitable polymeric material, such as polyphenylsulfone (commercially available from Solvay Advanced Polymers, LLC under a trade name of Radel R), polycarbonate (commercially available from SABIC under a trade name of Lexan or Lexan EXL) or polyamide (commercially available from DuPont under a trade name of Zytel). A casing cap is fabricated from aluminum, steel, or brass, and designed to receive a primer. The caselet and cap are securely joined to form the cartridge casing. The casing is loaded with a propellant charge, and a projectile is inserted into the open end and secured.

In terms of cap materials, several metals are useful for fabrication of the cap portion of a two-piece ammunition cartridge casing. These include brass and various steel and aluminum alloys and they all work satisfactorily. According to the present invention, the cap portion of the cartridge casings may be made of any material that is mechanically capable of withstanding a firing event. Non-limiting cap materials include any grade of brass, steel and steel alloys, aluminum and its alloys, ceramics, composites, and others. Of course, polymeric or polymer composite materials that are found to have sufficient mechanical properties for use as cartridge caps would also be useful in the practice of the present invention.

Turning to the construction of the cartridge case, according to the present invention, polymeric materials may comprise any portion of an ammunition cartridge casing, as long as the engineered propellant volume follows the restrictions and the overall casing follows the B/N guidance disclosed herein. Because of the more stringent mechanical demands on the bottom or base end of the cartridge as compared to the top end which secures the projectile, a two-piece or multi-piece cartridge casing may be preferred in which one piece is a high strength material that forms the base of the casing, e.g. the base may comprise a metal or a polymeric or composite material. For clarity, base is the portion of the casing that contains the primer and is opposite of the projectile end of the casing, as shown in any of the figures, for example.

In addition, although engineered propellant chambers are shown and described that comprise a single cylindrical cavity, it should be understood that this is merely meant to be illustrative. Other single or multiple engineered propellant chambers having any suitable cross-sectional shape may be used within the subsonic casings of the instant invention, such as, for example, hexagonal, triangular, square, etc. Likewise, the cross-section of the engineered propellant chamber need not be uniform along the longitudinal length of the casing. The dimensions of the engineered propellant volume could taper from proximal to distal ends, or from distal to proximal ends, or a series of interconnected chambers of propellant could be formed. In short, any size shape or number of engineered propellant chambers may be used providing these engineered propellant volumes or chamber satisfy the overall volume limitations described herein, and providing the overall casing meet the B/N ratio criteria set forth herein.

Finally, although three exemplary calibers are shown in Table I, above, it should be understood that many different types of ammunition articles are provided by the present invention. For example, polymeric materials that meet design guidelines of the invention may be used to produce subsonic ammunition components for various calibers of firearms. Non limiting examples include .22, .22-250, .223, .243, .25-06, .270, .300, .30-30, .30-40, 30.06, .303, .308, .357, .38, .40, .44, .45, .45-70, .50 BMG, 5.45 mm, 5.56 mm, 6.5 mm, 6.8 mm, 7 mm, 7.62 mm, 8 mm, 9 mm, 10 mm, 12.7 mm, 14.5 mm, 20 mm, 25 mm, 30 mm, 40 mm and others.

Exemplary Embodiments

The person skilled in the art will recognize that additional embodiments according to the invention are contemplated as being within the scope of the foregoing generic disclosure, and no disclaimer is in any way intended by the foregoing, non-limiting examples.

Methods and Materials

Testing polymer ammunition casing produced using the design of the present invention is done by firing fully assembled live ammunition articles. First, designs, which have been identified as useful for subsonic casing components, are molded using standard methods and equipment (e.g., injection molding) to form polymeric cartridge caselets. The caselets are then joined to metallic caps. The resulting cartridges are loaded with a primer and a propellant charge, the type and amount of which can be readily determined by a skilled artisan. A projectile is inserted into the open end of the cartridge and secured by mechanical, adhesive, ultrasonic, vibratory or heat welding or any other suitable method. The article is thus prepared for test firing. Any size, caliber, or type of ammunition article can be assembled for live testing.

Test firing subsonic polymer cased ammunition provided by this invention can be performed using any type of firearm corresponding to the size or caliber of the article produced. Ammunition articles can be test fired from a single shot firearm, a semi-automatic firearm, or an automatic firearm. Ammunition may be fired individually or from a clip, magazine, or belt containing multiple ammunition articles. Articles may be fired intermittently or in rapid succession; the rate of fire is limited only by the capabilities of the firearm. Any number of standard brass ammunition articles may be fired prior to loading polymer cased ammunition articles to preheat the firearm chamber for testing under simulated sustained rapid-fire conditions.

Example 1

.308 Caliber Testing High B/N Ratio

Ten lightweight polymeric ammunition articles (.308 caliber/7.62 mm) are assembled from injection molded caselets, polymeric restrictors and caps machined from cold headed brass blanks (C26000). Each cap has a pre-installed primer (CCI #34). The caselets are designed with ridges around the lower portion which create a snap interference fit with corresponding grooves on the cap interior, thus joining the caselet and cap securely. The cartridges are then filled with propellant (10 grains of WC 842). After loading the propellant, the projectiles (180 grains) are inserted into the cartridge and attached using an adhesive. The caselet has the following nominal dimensions: minimum wall thickness (B) of 0.190" ($41\frac{1}{1000}^{th}$ of an inch) and neck thickness (N) of 0.017" ($17\frac{1}{1000}^{th}$ of an inch). The B/N ratio of the design is ~11.2. The interior volume of the case is approximately 80% reduced in comparison to the equivalent supersonic round.

Ammunition articles are fired in a SCAR-17 and projectile velocities recorded. All of the velocities are less than 1,070 feet per second and rounds are all deemed subsonic. The ammunition cycles the weapon action without any issues.

Example 2

.308 Caliber Testing Low B/N Ratio

Ten lightweight polymeric ammunition articles (.308 caliber/7.62 mm) are assembled from injection molded caselets, polymeric restrictors and caps machined from cold headed brass blanks (C26000). Each cap has a pre-installed primer (CCI #34). The caselets are designed with ridges around the lower portion which create a snap interference fit with corresponding grooves on the cap interior, thus joining the caselet and cap securely. The cartridges are then filled with propellant (10 grains of WC 842). After loading the propellant, the projectiles (180 grains) are inserted into the cartridge and attached using an adhesive. The caselet has the following nominal dimensions: minimum wall thickness (B) of 0.100" (41 1/1000th of an inch) and neck thickness (N) of 0.017" (17 1/1000th of an inch). The B/N ratio of the design is ~5.8. The interior volume of the case is approximately 50% reduced in comparison to the equivalent supersonic round.

Ammunition articles are fired in a SCAR-17 and projectile velocities recorded. All of the velocities are less than 1,070 feet per second and rounds were all deemed subsonic. The ammunition does not cycle the weapon action and is operated manually.

DOCTRINE OF EQUIVALENTS

Those skilled in the art will appreciate that the foregoing examples and descriptions of various preferred embodiments of the present invention are merely illustrative of the invention as a whole, and that variations in the steps and various components of the present invention may be made within the spirit and scope of the invention. Accordingly, the present invention is not limited to the specific embodiments described herein but, rather, is defined by the scope of the appended claims.

What is claimed:

1. A method of reusing a subsonic ammunition article comprising:

providing a casing defining a generally cylindrical hollow body having a metallic cap at a first end thereof and a caselet at a second end thereof, the caselet having a proximal end defining a body region and a distal end defining a neck region, wherein the cap is interconnected with the proximal end of said caselet such that the casing at least partially encloses an internal cavity, and wherein the outer diameter of the caselet narrows from a first diameter at the body region to a second diameter at the neck region, the article having at least one propellant chamber disposed within the internal cavity of the casing, the propellant chamber having an open internal volume that is at least 20% reduced in comparison to the open internal volume of a standard casing of identical caliber, the casing further having a propellant disposed and confined within said propellant chamber and a primer disposed at the first end of said casing in combustible communication with said propellant, wherein the caselet and the propellant chamber at least partially comprise a polymeric material, and wherein the ratio of the minimum thickness of the wall of the body region of the caselet to the average wall thickness of the neck region of the ammunition casing is greater than 3;

firing the ammunition article; and discarding the fired polymeric caselet, retaining the fired metallic cap and attaching a new polymeric caselet to the existing metallic cap.

2. The method according to claim 1, wherein the cap and casing are threadingly interconnected.

3. The method according to claim 2, wherein the headspace of the ammunition article is adjusted by rotating the threads clockwise and/or counterclockwise until a desired headspace distance is reached.

4. The method according to claim 1 wherein said polymeric material additionally comprises at least one additive selected from the group consisting of plasticizers, lubricants, molding agents, fillers, thermo-oxidative stabilizers, flame-retardants, coloring agents, compatibilizers, impact modifiers, release agents, reinforcing fibers.

5. The method according to claim 1, additionally comprising one or more projectiles fitted in the second end.

6. The method according to claim 5, wherein the projectile is secured to the casing by an interconnection selected from the group consisting of mechanical interference, adhesive, ultrasonic welding, the combination of molding in place and adhesive, and hot crimping after the act of molding.

7. The method according to claim 1, wherein the polymeric material comprises a material selected from the group consisting of polyphenylsulfone, polycarbonate, and polyamide.

8. The method according to claim 1, wherein the polymeric material comprises a translucent or transparent polymer.

9. The method according to claim 1, wherein the polymeric material comprises a polymeric material possessing a glass transition temperature of less than 250° C.

10. The method according to claim 1, wherein the space defined between the outer wall of the caselet and the wall of the propellant chamber is formed of a solid material.

11. The method according to claim 1, wherein the space defined between the outer wall of the caselet and the wall of the propellant chamber includes one of either voids or ribs.

12. The method according to claim 1, wherein the propellant chamber comprises multiple separate internal volumes each in combustible communication with the primer.

13. The method according to claim 1, wherein the propellant chamber has a radial cross-section selected from the group consisting of circular, ovoid, octagonal, hexagonal, triangular, and square.

14. The method according to claim 1, wherein the radial cross-section of the propellant chamber is irregular along its longitudinal length.

15. The method according to claim 1, wherein the radial size of the propellant chamber tapers along its longitudinal direction.

16. The method according to claim 1, wherein the propellant chamber is formed of a separate restrictor body disposed within the internal cavity of the casing, and wherein the caselet and restrictor body are formed from one of either different polymeric materials or the same polymeric material.

17. The method according to claim 1, wherein the propellant chamber and caselet are formed of a single integral caselet body, and wherein the single integral caselet body is manufactured from two or more polymeric materials in one of either a blend mixture or distinct layers.

18. The method according to claim 17, wherein the cap and the single integral caselet body are joined using one of either a snap fit or threads.

19. The method according to claim 1, wherein the propellant chamber, caselet and cap are of a single integral casing body, and where the single integral casing body is manufactured from two or more polymeric materials in one of either a blend mixture or distinct layers.

20. The method according to claim 19, wherein a metallic component is used to separate the primer from the other components of the case.

* * * * *